United States Patent [19]

Washizu et al.

[11] Patent Number: 4,956,251

[45] Date of Patent: Sep. 11, 1990

[54] MULTICOLOR HEAT-SENSITIVE RECORDING MATERIAL

[75] Inventors: Shintaro Washizu; Toshimasa Usami; Sumitaka Tatsuta; Jun Yamaguchi, all of Shizuoka, Japan

[73] Assignee: Fuji Photo Film Co., Ltd., Kanagawa, Japan

[21] Appl. No.: 174,306

[22] Filed: Mar. 28, 1988

[30] Foreign Application Priority Data

Mar. 27, 1987 [JP] Japan ..... 62-075409

[51] Int. Cl.[5] ..... G03C 7/00; G03C 1/715; G03C 1/52; B41M 5/34

[52] U.S. Cl. ..... 430/138; 430/141; 430/142; 430/154; 430/156; 430/333; 430/952; 430/956; 503/204; 503/214

[58] Field of Search ..... 430/138, 142, 141, 156, 430/154, 333, 952, 956; 503/204, 214

[56] References Cited

U.S. PATENT DOCUMENTS

| | | | |
|---|---|---|---|
| 3,849,138 | 11/1974 | Wyckoff | 430/142 |
| 4,644,376 | 2/1987 | Usami et al. | 430/138 |
| 4,760,048 | 7/1988 | Kurihara et al. | 430/138 |
| 4,771,032 | 9/1988 | Yamaguchi et al. | 503/204 |
| 4,840,933 | 6/1989 | Usami et al. | 503/215 |

FOREIGN PATENT DOCUMENTS

| | | | |
|---|---|---|---|
| 39-10164 | 6/1964 | Japan | 430/142 |
| 57-165288 | 10/1982 | Japan | 503/204 |
| 57-165289 | 10/1982 | Japan | 503/204 |
| 58-136485 | 8/1983 | Japan | 503/204 |
| 60-253585 | 12/1985 | Japan | 503/204 |
| 61-11287 | 1/1986 | Japan | 503/204 |
| 61-16886 | 1/1986 | Japan | 503/204 |
| 61-242886 | 10/1986 | Japan | 503/204 |

OTHER PUBLICATIONS

Anon, *Camera,* vol. 43, No. 12, Dec. 1964, pp. 46, 48.

Schrieber, D. et al. *Research Disclosure,* Abstract #13148, Mar. 1975, pp. 53–56.

Derwent Abstract of Jap. Pat. Pub. #60–4,092, published Jan. 10, 1985, (Dainippon Printing Kk).

*Primary Examiner*—Charles L. Bowers, Jr.

*Attorney, Agent, or Firm*—Sughrue, Mion, Zinn, Macpeak & Seas

[57] ABSTRACT

A multicolor heat-sensitive recording material which comprises a transparent support having two or more of color-producing unit layers differing in hue of the produced color in such a situation that at least one unit layer is provided on each side of the support, wherein at least one color-producing unit layer is essentially transparent, namely, Haze % of said transparent layer is less than 40% and a multicolor heat-sensitive recording material further provided a transparent protective layer on the outermost color producing unit layer are disclosed.

6 Claims, 1 Drawing Sheet

MULTICOLOR HEAT-SENSITIVE RECORDING MATERIAL

FIELD OF THE INVENTION

The present invention relates to a heat-sensitive recording material which can develop many colors.

In more detail, it is concerned with a multicolor heat-sensitive recording material which enables substantially independent in recording of plural images differing in hue.

BACKGROUND OF THE INVENTION

A heat-sensitive recording method has many advantages in that (1) no particular developing step is required, (2) if paper is used as a support, the recording material prepared can have a quality akin to that of plain paper, (3) handling of a recording material used is easy, (4) images recorded has high color density, (5) this method can be embodied using a simple and cheap apparatus, (6) no noise is generated upon recording, and so on. Therefore, heat-sensitive recording materials have recently come into wide use in the fields of a black and white facsimile and a printer. These heat-sensitive recording materials are prepared by coating a combination of a color producing agent and a color developing agent on a support, such as paper, synthetic paper, etc., and a record is made thereon through a process of heating with a thermal head on the basis of electric signals corresponding to an original.

In the above-described recording fields also, a requirement to get color hard copies with ease from data terminals of information equipments including a computer, a facsimile and so on has been increased with the rapid advance of information industry. As a method to fulfil such a requirement, an ink jet process and a heat-sensitive transfer process have been examined. In the ink jet process, however, a coloring agent and other ingredients in ink tend to cause stopping-up of a nozzle because of narrowness of the nozzle out of which coloring agent-containing ink is shot. Therefore, such a process has a serious defect that it lacks reliability of the records formed. In the heat-sensitive transfer process, on the other hand, ink on an ink sheet is dissolved imagewisely by heating, and transferred onto paper. Accordingly, in order to obtain, for example, a 4-color image four ink sheets, are required. That is, such a process is uneconomical since it requires a great number of ink sheets. In addition, a user must devote a ceaseless attention so that ink solutions, in case of the ink jet process, and ink sheets, in case of the heat-sensitive transfer process, may not become scarce in supply. That is to say, both the processes force bothersome supervision on users.

In contrast to the foregoing processes, a heat-sensitive recording process requires no bothersome supervision, and can provide highly reliable records. Therefore, in case a multicolor recording material is realized according to this process, the material can be free from the defects of conventional processes, and used with ease. In order to render a record multicolored, however, it is necessary to provide, over one support, color-producing mechanisms in number corresponding to that of colors to be produced, and to make the color-producing mechanism fulfil their respective functions under control. Although much efforts to meet the above-described necessities have so far been made, all materials proposed are still insufficient in respect of hue and color separation of produced colors.

For instance, there is a conventional method in which plural colored units are simply added one after another in proportion as applied heat energy is increased, and thereby the produced colors are mixed to cause changes in hue as accompanied by turbidity, as described in Japanese Patent Publication Nos. 19989/76 and 11231/77, Japanese patent application (OPI) Nos. 88135/79, 133991/80 and 133992/80 (The term "OPI" as used herein means an "unexamined published application"). As another conventional method, there is known one which introduces decolorization mechanisms, such that a color produced by a color-producing unit at a low temperature is decolorized by the reaction with a decolorizing agent at the same time as a color-producing unit capable of making a thermal response at a higher temperature produces its color, as described, e.g., in Japanese Patent Publication Nos. 17868/75, 5791/76, 14318/82 and 14319/82, and Japanese patent application (OPI) No. 161688/80.

In the above-described methods, not only the number of realizable hues is small, but also turbidity due to blur and color mixing is generated. Therefore, it is hard to say that the heat sensitive materials employed in the foregoing methods have satisfactory functions as a color hard copy. In particular, it is a fatal defect as a color hard copy that the number of hues of producible colors is small in principle. One material reason why the conquest of this defect has not been successful as yet consists in the following circumstances. That is, if an increase in number of producible hues can be achieved by simply increasing the number of fractions of heat energy applied for printing and, at the same time, making a large difference in energy between one fraction and another one, it suffices in principle for this purpose to design a heat-sensitive recording material provided with an increased number of heat-sensitive color-producing layers on the same support so as to correspond to various heat energies applied thereto respectively. In reality, however, there occur problems in respect of freshness keeping property (the so-called fog) of the recording material itself and so on, when heat energy applied for printing is extended to a lower region than usual, while when the energy is extended to a higher region, there arise new grave problems that images formed become sticky through their burning or fusion (e.g., a sticking phenomenon tends to occur), whereby the traveling facility of a thermal head upon printing is deteriorated, the span so thermal-head life become short, and so on. Accordingly, the largest allowable number of fractions of heat energy to be applied for printing has so far been two or so from the practical viewpoint of satisfactory color separation.

In the meantime, an opaque support, such as paper, synthetic paper or the like, has usually been employed as the support of a heat-sensitive recording material. This depends merely on the way of using the produced color images as reflected images to be read from one side.

As hitherto known examples of a heat-sensitive recording material provided with a substantially transparent support, mention may be made of those described in Japanese Patent Publication No.20151/'65, Japanese patent application Nos. 68875/85 and 184483/85. Therein, the transparent support was used for the purpose of obtaining a high quality image, especially excellent in contrast or luster, by observing the images recorded by heat from the side of the transparent support.

Still another example of providing heat-sensitive color-producing layers on both sides of a support is disclosed in Japanese patent application (OPI) No. 208298/82. This aims at reduction of loss in aspects of cost, keeping space of printed copies, and so on by printing records on both sides of an opaque support. Accordingly, all the materials cited above do not have any special contribution to obviation of the foregoing defects inherent in multicolored recording material.

Moreover, inventions, in which two or more coloring images are obtainable by using recording materials which comprises a transparent support having on each side a heat-sensitive recording layer differing in hue of the produced color, are disclosed in Japanese patent application Nos. 114431/'74, 3640/'75 and 4092/'85.

However, in these recording materials, coloring components and color developers are simply dispersed in the heat-sensitive layer as solid states, color-producing layers themselves become opague and no multicolor images clearly devided into each colors are obtainable, since light is scattered by above mentioned dispersed solids. In the disclosure of Japanese patent application No. 4092/'85, some descriptions, which means that each component was solved and coated in same layer to improve transparency of the thermocoloring layer, are found but so called fog occurs in this case since coloring of each component before printing occurs easily.

Therefore, all these known technologies are essentially insufficient for multicolor recording material since the number of colors which can be distinguished each other are small.

As the results of our energies research on the above-described defects, it has been found that improved heat-sensitive color image can be obtained by providing coloring layers which are essentially transparent and can produce colors differing in hue on each side of a transparent support, then the present invention has been completed.

SUMMARY OF THE INVENTION

A first object of the present invention is to provide a heat-sensitive recording material which is essentially able to produce multicolor image by sufficiently controling the number of coloring hue and color separation.

A second object of the present invention is to provide a method to obtain an excellent multicolor image using heat-sensitive recording process.

The above-described objects are attained with a multicolor heat-sensitive recording material which comprises a transparent support having two or more of color-producing unit layers differing in hue of the produced color in such a situation that at least one unit layer is provided on each side of the support, wherein at least one color-producing unit layer is essentially transparent and said transparent layer is prepared by coating a composition containing a combination of a diazonium compound and a coupler or a combination of an electron donating dye precurssor and a color developer as a color former together with other additives; at least said diazonuim compound or electron donating dye precursor is enclosed in a microcapsule, on the otherhand said coupler or color developer which exists in the composition with said microcapsule is dispersed in a emulsion obtained by dissolving it said coupler or color developer into an organic solvent slightly soluble or insoluble in water then subjecting the resulting solution to an emulsfying dispersion treatment.

In accordance with the present invention, a multicolor image which is excellent in hue, color separation and preserbability, which can not be obtained by conventional heat-sensitive recording methods, is obtained. Further, the invention makes it feasible to observe images as not only transmitted image, but also reflected image. Thus, the invention opens the way of forming natural color images by nonsilver photography, and has considerable significance.

Figure 1:
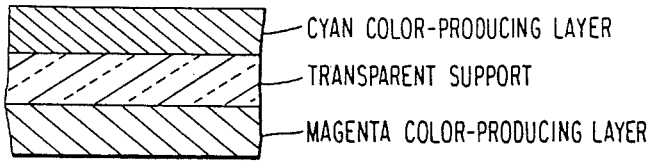
FIG. 1 is a sectional view illustrating example of heat sensitive material having one color-producing layer on both sides of a support, respectively, in accordance with present invention.

In the drawings, symbols 1 7 represent hues of green, yellow, red, black, blue, cyan and magenta respectively.

DETAILED DESCRIPTION OF THE INVENTION

A method for obtaining easily multicolor images of good quality by the use of the heat-sensitive recording material of the present invention is illustrated according to the figures.

Figure 2:
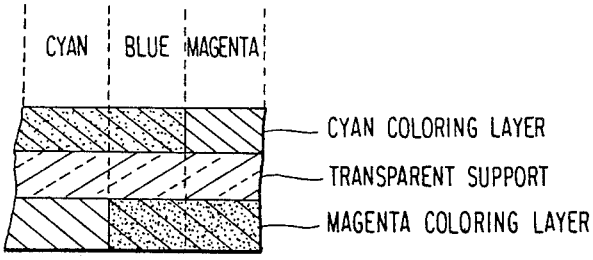
FIG. 2 illustrates an example of the coloration caused in the heat sensitive material shown in FIG. 1 when thermal printing was carried out.

FIG. 1 shows an example of the heat-sensitive recording material of the present invention, wherein on both side of a transparent support are provided a cyan coloring layer and a magenta coloring layer, respectively. Preparing the both heat-sensitive layer to be colored with same thermaly energy, cyan and magents colors can be preoduced on both side of the support independently as shown FIG. 2, if thermal recording is made on both side of the heat-sensitive recording material using heat pens or thermal heads having essentially same thermal energy. When resultant heat-sensitive recording material is obserbed from one side of the material, cyan, cyan +magenta (blue) and magenta can be produced in a good color separation, since the support is essentially transparent (see, FIG. 2).

Figure 3:
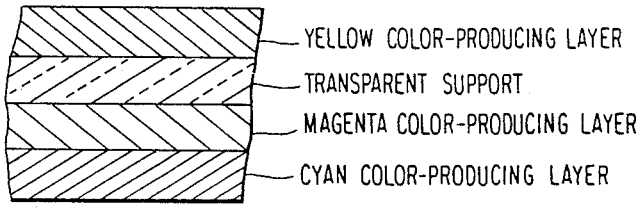
FIG. 3 is a sectional view illustrating example of heat sensitive material having three color-producing layers in accordance with the present invention.

Although above example was the case considering two coloring unit of cyan and magenta, basically same result can be obtained in a case enclosing three coloring unit of cyan, magenta and yellow. Namely, this is the case of e.g., providing a yellow coloring layer on a one side of a transparent support, on the otherhand, magenta coloring layer then cyan coloring layer on the other side of the transparent support (see, FIG. 3).

Figure 4:
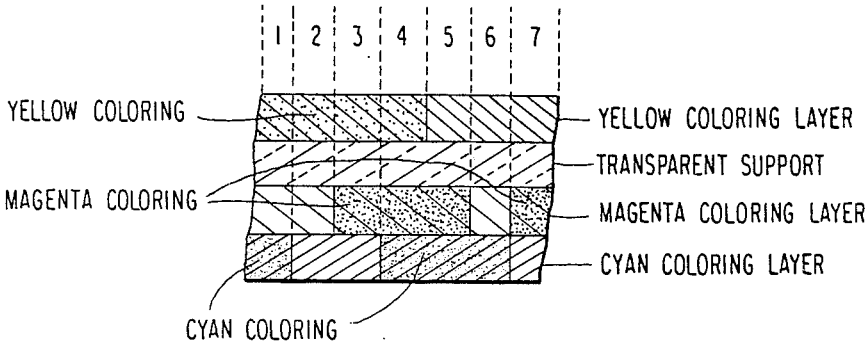
FIG. 4 illustrates an example of the coloration caused in the heat sensitive material shown in FIG. 3 when thermal printing was carried out.

In this case, it is to be desired from the standpoint of independent production of the third color that system for carrying out both color-producing coupling reaction and photo-fixation reaction of a diazo compound, as described in Japanese patent application (OPI) No. 40192/86, should be adopted. Namely, the yellow color- and cyan color-producing layers are firstly made to produce their respective colors on both side of the support at a rather low temperature by recording of low thermal energy. Then photofixation is carried out using a light source of particular wavelengths which enable selective photolysis of only the diazo compound contained in the yellow layer and cyan layer, and then heat recording is made on the thermally low sensitive magenta layer by application of relatively high thermal energy, compared with the preceding heat recordings. Thus, cyan, magenta and yellow colors are produced independently on both sides of the support. This method is quite meaningful in practical since the thermal energy used for color-production of magenta layer does give too heavy work load to both the recording material and recording apparatus. When the resultant heat sensitive material is observed from one side of the transparent support, seven basic colors, i.e., cyan, magenta, yellow, cyan+magenta (blue), magenta+yellow (red), cyan+yellow (green), and cyan+magenta+yellow (black), can be materialized therein in a good condition of color separation, though so far regarded as a difficult matter in the heat sensitive recording (See FIG. 4).

Since yellow color-producing layer and other color-producing layer are separated by the support, a fixing process is not always necessary for the yellow color-producing layer to reproduce beforementioned all colors.

Numbers of colors producible by color mixing can be enlarged in a multiple manner by controlling the color-production in each unit through proper adjustment of heating energy for printing. This matter can be easily understood by those skilled in the art.

As for the processes of multicolor production in the present invention, brief illustration is given above. Materials to be used for the heat-sensitive recording material of the present invention are components which produce colors basing on a contact of each component according to heat, e.g., a combination of an electron donating dye precursor with an acid material or a combination of a diazo compound with a coupling compound.

An electron donating dye precursor to be used in the combination of the former may be any compound provided that it can produce a color by donating an electron or accepting a proton of an acid or the like. In general, however, compounds of the kind which are nearly colorless, have a specified moiety, such as lactone, lactam, sultone, spiropyran, ester, amide, or so on, and undergo the ring-opening or the bond cleavage of the partial skeletons set forth above when brought into contact with a color developing agent are employed. Specific examples of such basic dye precursors include Crystal Violet lactone, benzoyl leuco Methylene Blue, Malachite Green lactone, Rhodamine B lactam, 1,3,3-trimethyl-6'-ethyl-8'-butoxyindolinobenzospiropyran, and so on.

As examples of a color developing agent to be used in combination with the foregoing electron donating dye precursors, mention may be made of phenol compounds, organic acids or metal salts thereof, oxybenzoates, and so on. A preferred melting point of a color developing agent ranges from 50° C. to 250° C., particularly from 60° C. to 200° C. In particular, phenols and organic acids which have a melting point ranging from 60° to 200° C. and are slightly soluble in water are favored over others.

Specific examples of these color developing agents are described, e.g., in Japanese patent application(OPI) No. 132990/85.

The diazo compounds to be used as color forming agent in the present invention are those capable of forming colors of desired hues by reacting with coupling components described hereinafter, but decomposing on exposure to light of particular wavelengths prior to the coupling reaction to lose their color-forming ability, that is, no longer form colors by making coupling components act thereon. The hue obtained in such a color-producing system depends mainly on the diazo dye produced by the reaction of a diazo compound with a coupling component. Consequently, as is well known, the hue of color to be produced can be changed with ease by modifying the chemical structure of diazo compound, or/and that of a coupling component. Almost arbitrary hue can be obtained depending on how they are combined. Therefore, one kind of coupling component and other additives may be incorporated in one layer in which various kinds of diazo compounds are dispersed. In this case, individual color-producing units are constituted with a diazo compound different from each other one, and the common coupling component and additives. On the other hand, some kinds of coupling components may be dispersed into separate layers, and in each layer are incorporated the same diazo compound and additives as in every other layer. In this case, individual color-producing units are constituted with a coupling component different from each other one, and the common diazo compound and additives. In any case, each color-producing unit is constituted with one or more kind of diazo compound, one or more kind of coupling component and other additives which are combined so as to produce a color of hue different from that obtained in every other color-producing unit.

The term "photo-decomposable diazo compounds" as used in the present invention refers mainly to aromatic diazo compounds, including aromatic diazonium salts, diazosulfonate compounds, diazoamino compounds and the like. The photo-decomposable diazo compounds are illustrated below citing diazonium salts as typical examples.

In general, the wavelength at which diazonium salts undergo photolysis are said to be the wavelengths of their respective absorption maximum. In addition, the absorption maximum wavelength of a diazonium salt is known to vary between about 200 nm and about 700nm according to its chemical structure (Takahiro Tsunoda & Tsugio Yamaoka, Nippon Shashin Gakkaishi, vol. 29(4), pp. 197–205 (1965), the title of which means "photolysis of light-sensitive diazonium salts and chemical structures thereof", can be referred to). Namely, when diazonium salts are employed as a photo-decomposable compound, they decompose upon exposure to light of wavelengths specified depending on their respective chemical structures, and the hue of a dye to be produced by coupling reaction can be varied by using the diazonium salts of a modified chemical structure even when the same coupling component is used. Accordingly, diazonium salts can be used to advantage. The diazonium salts are compounds represented by the general formula of $ArN_2^+ X^-$ (wherein Ar represents a substituted or unsubstituted aromatic moiety, $N_2^+$ represents a diazonium group, and $X^-$ represents an acid anion).

In a preferred embodiment of the present invention, two or more of diazonium compounds differing in photolysis wavelength are used.

Specific examples of diazonium compounds having their respective photolysis wavelengths in the vicinity of 400 nm include 4-diazo-1-dimethylaminobenzene, 4-diazo-1-diethylaminobenzene, 4-diazo-1-dipropylaminobenzene, 4- diazo-1 - methylbenzylaminobenzene, 4-diazo-1-dibenzylaminobenzene, 4 - diazo- 1-ethylhydroxyethylaminobenzone, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4 diazo-1-anilinobenzene, 4-diazo-1-toluylmercapto-2,5-diethoxybenzene, 4-diazo-1,4-methoxybenzoylamino-2,5-diethoxybenzene, and so on. Specific examples of compounds having their photolysis wavelengths in the range of 300 to 370 nm include 1 -diazo-4-(N,N-dioctylcarbamoyl)benzene, 1-diazo-2-octadecyloxybenzene, 1-diazo-4-(4-tert-octyl-phenoxy)benzene, 1-diazo-4-(2,4-di-tert-amylphenoxy)benzene, 1-diazo-2-(4-tertoctylphenoxy)benzene, 1 -diazo-5-chloro-2-(4-tertoctylphenoxy)benzene, 1-diazo-2,5-bis-octadecyloxybenzene, 1-diazo-2,4-bis-octadecyloxybenzene, 1-diazo-4-(N-octylteuroylamino)benzene, and so on. Photolysis wavelengths of the aromatic diazonium compounds represented by the above-cited examples can be changed over a wide range by replacing their individual substitutent groups by other arbitrary ones.

Specific examples of acid anions include $C_nF_{2n+1}COO^-$(n=an integer of 3 to 9), $C_mF_{2m+1}SO_3^-$(m=an integer of 2 to 8), $(C\ F_{2l+1}SO_2)_2CH^-$(*l=an integer of* 1 to 18),

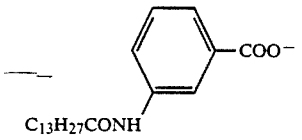

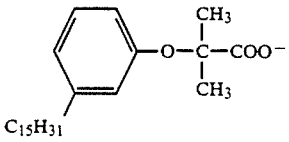

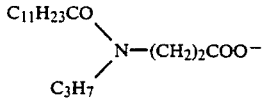

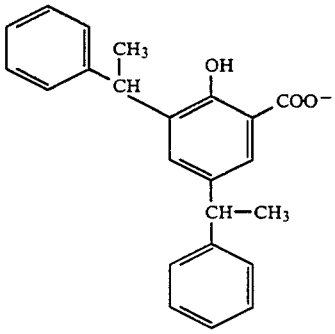

-continued

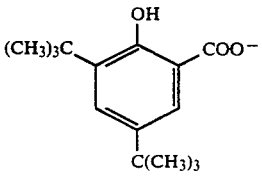

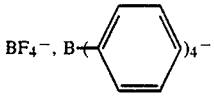

$PF_6^-$, and so on.

Specific examples of diazonium compounds (diazonium salts) are illustrated below.

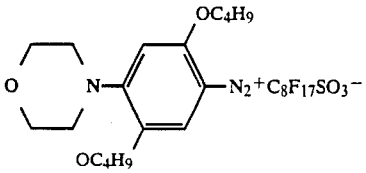

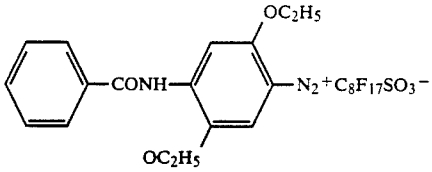

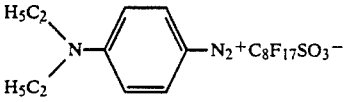

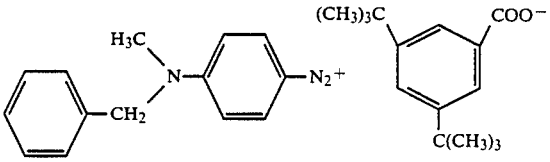

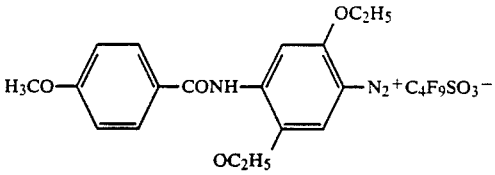

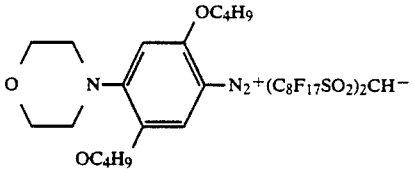

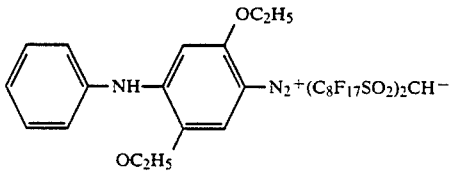

-continued

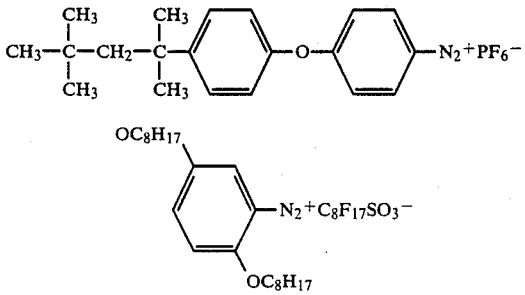

Diazosulfonate compounds which can be used in the present invention are those represented by the following general formula:

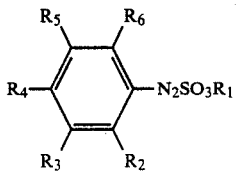

wherein $R_1$ represents an alkali metal, or an ammonium compound; $R_2$, $R_3$, $R_5$ and $R_6$ each represents a hydrogen atom, a halogen atom, an alkyl group, or an alkoxyl group; and $R_4$ represents a hydrogen atom, a halogen atom, an alkyl group, an amino group, a benzoylamido group, a morpholino group, a trimercapto group, or a pyrrolidino group.

Many compounds are known as such diazosulfonates, and can be obtained by treating the corresponding diazonium salts with a sulfite.

Preferred examples of diazosulfonate compounds include benzenediazosulfonates having such a substituent group as 2-methoxy, 2-phenoxy, 2-methoxy-4-phenoxy, 2,4-dimethoxy, 2-methyl-4-methoxy, 2,4-dimethyl, 2,4,6-trimethyl, 4-phenyl, 4-phenoxy, 4-acetoamide, or so on; and benzenediazosulfonates having such a substituent group as 4-(N-ethyl-N-benzylamino), 4-(N,N-dimethylamino), 4-(N,N-dimethylamino), 4-(N,N-diethylamino)-3-chloro, 4-pyrrolidino-3-chloro, 4-morpholino-2-methoxy, 4-(4'-methoxybenzoylamino)-2,5-butoxy, 4-(4'-trimercapto)-2,5-dimethoxy, or so on. When these diazosulfonoate compounds are used, it is desired that optical exposure should be carried out before printing for the purpose of activation of the diazosulfonates.

Other diazo compounds which ca be used in the present invention are diazoamino compounds. Specific examples thereof include those obtained by coupling diazo group with dicyandiamide, sarcosine, methyltaurin, N-ethylanthranicacid-5-sulfonic acid, monoethanolamine, diethanolamine, guanidine, etc.

A developing agent to be combined with diazo compounds which can be used in the present invention is a coupling component to form dyes by coupling with the diazo compounds (diazonium salts).

As examples of such a developing agent, mention may be made of not only 2-hydroxy-3-naphthoic acid anilide, but also those describes in Japanese patent application (OPI) No. 287485/85, including resorcin.

Also, image with arbitrary hue can be formed by the combined use of two kinds or more of these coupling components. As the coupling reaction of the diazo compounds with the coupling components is liable to take place in a basic atmosphere, a basic substance may be contained in a color-producing unit layer.

Suitable basic substances include those soluble slightly or insoluble in water, and substances capable of producing an alkali upon heating. As examples of such substances, mention may be made of inorganic and organic ammonium salts, organic amines, amides, urea and thiourea, derivatives of these ureas, thiazoles, pyrroles, pyrimidines, piperazines, guanidines, indoles, imidazoles, imidazolines, triazoles, morpholines, piperizines, amidines, formamidines, pyridines, and other nitrogen-containing compounds. Specific examples of the above compounds are described, e.g., in Japanese patent application (OPI) No. 132990/85.

Two or more of basic substances may be used.

Some of materials which take part in the abovedescribed color-producing reactions are used in an microencapsulated condition, from the standpoints of improving a transparency of a heat sensitive layer, ensuring freshness keeping property through prevention of contact between a color-forming agent and a color-developing agent at ordinary temperatures (prevention of fog), and controlling the sensitivity concerning color production so that the color-producing reaction may take place by application of intended quantity of thermal energy.

Microcapsules preferably employed in the present invention have a microcapsule wall of such a property as to prevent the contact between substances present inside and outside the wall at ordinary temperatures through its insulation function, but to lower its permeability barrier to some of the substances only while it is heated to a temperature higher than a prescribed one. This phenomenon discovered by us previously belongs to new technology. A permeation starting temperature can be freely controlled by properly chosing a capsule wall material, a capsule core material, and additives. In this case, the permeation starting temperature corresponds to the glass transition point of the capsule wall (as described, e.g., in Japanese patent application(OPI) No. 91438/84, Japanese patent application Nos. 190886/84 and 99490/84, and so on).

For controlling the intrinsic glass transition point of a capsule wall, it is necessary to change the kind of a capsule wall-forming agent.

Examples of macromolecular substances for capsule wall are a polyurethane, a polyurea, polyamide, polyester, polycarbonate, urea-formaldehyde resin, melamine resin, polystyrene, styrenemethacrylate copolymer, styreneacrylate copolymer, gelatin, poly(vinylpyrrolidone), poly(vinylalcohol), etc. These macromolecular substances can be used as a combination of two or more in the present invention.

Also, among tho above substances, a polyurethane, polyurea, polyamide, polyester or polycarbonate is preferred in this invention. Especially, polyurethane and polyurea are preferable.

The method of preparing a wall of a microcapsule by polymerizing the reactant from the inside of an oil drop is desirable in the present invention.

In the present invention, when a wall of a macromolecular substance is formed around the oil drop obtained by emulsifying a core substance containing a reactive substance such as a color former, etc. to produce a microcapsule, the reactant to form a macromolecular substance is added inside and/or outside the oil drop.

Details of the microcapsules, which are used preferably in the present invention, such as a method to manufacture the microcapsule are described, e.g., in Japanese Patent publication (OPI) No. 22716/'86.

An organic solvent to be used for forming oil drop can be properly selected from those having high boiling point. Particulalarly it is desirable to use hereafter mentioned organic solvent which is suitable to solve color developer, since it is excellent in a property to solve color former and can make increase coloring density as well as coloring reaction velocity when thermal recording have been done and can prevent fogs also.

Microcapsules can be formed by the use of emulsion containing an ingredient to be microencapsulated in a concentration of 0.2 wt. % or more.

In forming a color-producing layer containing a combination of a diazo compound and a coupling component as a color-producing unit, it is desirable to use the coupling compound and a basic substance in amounts of 0.1 to 10 parts by weight and 0.1 to 20 parts by weight, respectively, per 1 part by weight of the diazo compound. On the other hand, in forming another color-producing layer containing a combination of a basic dye precursor and a color developing agent as a color producing unit, the color developing agent is preferably used in an amount of 0.3 to 160 parts by weight, particularly 0.3 to 80 parts by weight, per 1 part by weight of the basic dye precursor.

A preferred size of microcapsules to be employed in the present invention is 2 microns or less, particularly 1 micron or less, on a volume average basis according to the evaluation method described, e.g., in Japanese patent application (OPI) No. 214990/'85.

Desirable microcapsules which are produced in the above-described manner are not those of the kind which are ruptured by heat or pressure, but those of the kind which have a microcapsule wall through which reactive subsatnces present inside and outside the individual microcapsules respectively can permeate at high temperature to react with each other.

In the present invention, a color-producing assistant can be used.

Color-producing assistants which can be used in the present invention are those which can increase a color density of the image printed by application of heat, or can contribute to a drop in the lowest possible temperature for color production. More specifically, they can lower the melting points of coupling compounds, alkalis, basic dye precursors, color developing agents, diazo compounds, etc., or the softening points of capsule walls, whereby such a condition as to facilitate the reaction among diazo and coupling compounds, or the reaction between basic dye precursors and color developing agents, can be created.

Suitable color-producing assistants are phenol compounds, alcoholic compounds, amide compounds, sulfonamide compounds and so on. Specific examples of these compounds include p tert-octylphenol, p-benzyloxyphenol, p-oxybenzoic acid phenyl ester, carbanilic acid benzyl ester, carbanilic acid phenetyl ester, hydroquinone dihidroxyethyl ether, xylylene diol, N-hydroxyethyl methanesulfonic acid amide, N-phenylmethanesulfonic acid amide, and so on. These compounds may be contained in the core substance of microcapsules, or present outside the microcapsules.

In the present invention, such a color developers for electron donating dye precursors or diazo compounds are used in a form of emulsified dispersion. The dispersion can be prepared by dissolving color developers in an organic solvent slightly soluble or insoluble in water, and mixing the resulting solution with an aqueous phase which contains a surface active agent, and a water-soluble high polymer as a protective colloid to emulsify and to disperse the solution in the aqueous phase.

An organic solvent to be used for dissolving the electron donating dye precursors and color developers can be properly selected from esters having high boiling point or generally used oils in a pressure sensitive recording material. In these oils, specially oils having more than two benzene rings but a number of hetero atom in their molecular structure is less than a certain number are desirable.

Some of desirable oils are compounds represented by the following general formulae (I) to (IV), triarylmethanes (such as tritoluylmethane, toluyldiphenylmethane), terphenyl compounds (such as terphenyl), alkylated diphenyl ethers (such as propyldiphenyl ether), hydrogenated terphenyl compounds (such as hexahydroterphenyl), diphenyl ethers, and so on. Of these organic solvents esters are desirable from a view points of a stability of the developer dispersed emulsion.

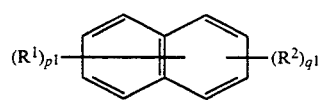

(I)

In the above formula, $R^1$ represents a hydrogen atom, or an alkyl group containing 1 to 18 carbon atoms; $R^2$ represents an alkyl group containing 1 to 18 carbon atoms; and $p^1$ and $q^1$ each represents an integer of 1 to 4, provided that the total number of alkyl groups therein is 4 or less. Preferred alkyl groups represented by $R^1$ and $R^2$ are those containing 1 to 8 carbon atoms.

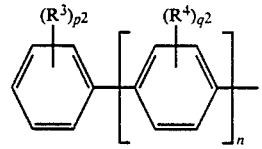

(II)

In the above formula, $R^3$ represents a hydrogen atom, or an alkyl group containing 1 to 12 carbon atoms; $R^4$ represents an alkyl group containing 1 to 12 carbon atoms; and n is 1 or 2. $p^2$ and $q^2$ each represents an integer of 1 to 4. The total number of alkyl groups is 4 or less in case of n=1, while it is 6 or less in case of n=2.

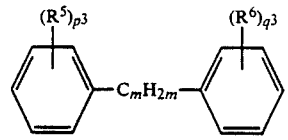

(III)

In the above formula, $R^5$ and $R^6$, which may be the same or different, each represents a hydrogen atom, or an alkyl group containing 1 to 18 carbon atoms. m represents an integer of 1 to 13. $p^3$ and $q^3$ each represents an integer of 1 to 3, provided that the total number of alkyl groups is 3 or less.

Of alkyl groups represented by $R^5$ and $R^6$, those containing 2 to 4 carbon atoms are particularly preferred.

Specific examples of the compounds represented by the formula (I) include dimethylnaphthalene, diethylnaphthalene, diisopropylnaphthalene, and the like.

Specific examples of the compounds represented by the formula (II) include dimethylbiphenyl, diethylbiphenyl, diisopropylbiphenyl, diisobutylbiphenyl, and the like.

Specific examples of the compounds represented by the formula (III) include 1 -methyl-1-dimethylphenyl-1 -phenylmethane, 1-ethyl-1-dimethylphenyl-1-phenylmethane, 1-propyl-1-dimethylphenyl-1-phenylmethane, and the like.

Specific examples of esters include phosphates (e.g., triphenyl phosphate, tricresyl phosphate, butyl phosphate, octyl phosphate, cresyl-bi-phenyl phosphate), phthalates (e.g., dibutyl phthalate, 2-ethylhexyl phthalate, ethyl phthalate, octyl phthalate, buthlbenzyl phthalate, tetrahydro dioctyl phthalate, benzoates (e.g., ethyl benzoate, propyl benzoate, butyl benzoate, isopentyl benzoate, benzyl benzoate), abietates (e.g., ethyl abietate, benzyl abietate ), dioctyl adipate, diethyl succinate, isodecyl succinate, dioctyl azelate, oxalates (e.g., dibutyl dipentyl oxalate), diethyl malonate, maleates (e.g., dimethyl maleate, diethyl maleate, dibutyl maleate), tributyl citrate, sorbic esters (methyl sorbate, ethyl sorbate, butyl sorbate), sebacic esters (dibutyl sebacate, dioctyl sebacate), ethyleneglycol esters (e.g., formic acid monoesters and diesters, butyric acid monoesters and diesters, lauric acid monoesters and diesters, palmitic acid monoesters and diesters, stearic acid monoesters and diesters, oleic acid monoesters and diesters), triacetin, diethylcarbonate, diphenylcarbonate, ethylenecarbonate, propylenecarbonate, boric acid esters (e.g., tributyl borate, tripentyl borate). Of these esters, it is particularly preferred to use tricresyl phosphate from the standpoint of stabilization of emulsified dispersion of the color developers.

In the above formula, R represents alkyl group containing 1 to 18 carbon atoms but those containing 1 to 5 carbon atoms are desirable.

The above-cited oils can be used as a mixture of two or more thereof, or in combination with other oils.

Further, auxiliary solvents, which have low boiling points and act as dissolution aid, can be added to the foregoing organic solvents in the present invention. Some of these organic solvents are ethyl acetate, isopropyl acetate, butyl acetate, methylene chloride, and the like.

Water soluble high polymers to be contained as a protective colloid in an aqueous phase, which is to be mixed with an oily phase wherein color developers are dissolved, can be selected properly from known anionic, nonionic or amphoteric high polymers. Of these high polymers, polyvinylalcohol, gelatin, cellulose derivatives and the like are preferred.

Surface active agents to be contained additionally in the aqueous phase can be selected properly from anionic or nonionic surface active agents of the kind which do not cause any precipitation or condensation by interaction with the above-described protective colloids. As examples of surface active agents which can be preferably used, mention may be made of sodium alkylbenzenesulfonates (such as sodium dodecylbenzenesulfonate), sodium alkyl sulfates (such as sodium lauryl sulfate), sodium dioctylsulfosuccinates, polyalkylene glycols (such as polyoxyethylene nonylphenyl ether) and so on.

An emulsified dispersion of color developers to be used in the present invention can be prepared with ease by mixing an oil phase containing the color developers and an aqueous phase containing a protective colloid and a surface active agent with a general means for preparing a fine grain emulsion, such as a high-speed stirrer, an ultrasonic disperser or so on, to disperse the former phase into the latter phase.

An oil size (diameter) of the color developer emulsified dispersion is desired to be less than 7 micron to obtain transparent heat sensitive layer having a haze % value of 40. Particularly from 0.1 to 5 micron is preferable.

A value of ratio (weight of oil phase/weight of aqueous phase) is desired to be from 0.02 to 0.6, especially, from 0.1 to 0.4. If the value is less than 0.02, the color developer emulsified dispersion becomes too diluted one since the aqueous phase becomes too much and sufficient coloring can not be obtained. On the otherhand when the value becomes larger than 0.6, handling becomes troublesome since a viscosity of the solution becomes high, moreover, the tranceparency of an obtained heat sensitive layer becomes low.

In preparing the heat sensitive material of the present invention, a proper binder can be used for coating.

Suitable examples of binders which can be used include polyvinyl alcohol, methyl cellulose, carboxymethyl cellulose, hydroxypropyl cellulose, gum arabic, gelatin, polyvinyl pyrrolidone, casein, styrene-butadiene latex, acrylonitrile-butadiene latex, and various kinds of emulsions of polyvinylacetate, polyacrylic acid esters, ethylene-vinylacetate copolymer and so on. Such a binder is used at a coverage of 0.5 to 5 $g/m^2$ on a solids basis.

In addition to the above-described ingredients, an acid stabilizer, such as citric acid, tartaric acid, oxalic acid, boric acid, phosphoric acid, pyrophosphoric acid, etc., can be added to the heat sensitive material of the present invention.

An image recorded in the heat sensitive material of the present invention can be observed from one side as transmitted image or reflected image. In the latter case, the image is not clear since the back side is seen through the background area. Therefore, a white pigment may be added to a heat sensitive layer, or a layer containing a white pigment may be additionally provided. In both cases, it is effective to add a white pigment to the outermost layer located on the opposite side of the recorded-image observation. Suitable examples of white pigments include talc, calcium carbonate, calcium sulfate, magnesium carbonate, magnesium hydroxide, alumina, synthetic silica, titanium oxide, barium sulfate, kaolin, calcium silicate, urea resin, and so on.

In the case where the Microencapsulation method is not employed, it is to be desired that diazo compounds, coupling compounds, basic dye precursors, color developing agents and so on should be used in the form of a solid dispersion prepared with a sand mill or the like. Herein, these ingredients are dispersed into separate solutions of water-soluble high polymers. As examples of water-soluble high polymers used preferably, mention may be made of those employed for the microencapsulation described above. A suitable concentration of such a water-soluble high polymer in each solution is 2 to 30 wt. %, and each ingredient, such as a diazo compound, a coupling component, a basic substance, a basic dye precursor or a color developing agent, is added to the water-soluble high polymer solution so as to amount to 5 to 40 wt. % therein.

A preferred size of particles dispersed is 10 microns or less.

A preferred coverage of a heat sensitive layer ranges from 3 to 20 g/m$^2$, particularly from 5 to 15 g/m$^2$. When the coverage is below 3 g/m$^2$ satisfactory sensitivity can not be obtained, whereas coverages beyond 20 g/m$^2$ can not contribute to improvement of image quality and becomes unfavorable in respect of production cost.

In order to obtain clearer hue in the heat recording, it is to be desired that each color-producing unit layer should be transparent in a substantial sense. The meaning of transparent in a substantial sense is less than 40% when haze (%) measured with an integral sphere process HTR meter (produced by Nippon Seimitsu Kogyo Co., Ltd.), is used as a measure of it. Especially 30% or less and more particularly 20 (%) or less is desirable.

However, for the transparency of a heat-sensitive layer of a test sample is remarkably affected by light-scattering caused by minute roughness of a surface of the heat-sensitive layer. Therefore, a transprent adhesive tape is stuck on the surface of the heat-sensitive layer to prevent the light scattering then measurement is carried out to estimate an intrinsic transparency of the heat-sensitive layer.

In the present invention, a protective layer, which is arbitrarily provided on the heat-sensitive layer, is at least made of polyvinylalcohol modified with silicon and colloidal silica.

The modified polyvinylalcohol with silicon, which is used in the present invention is not restricted particularly if it has a silicon atom in it's molecular structure, however, it is preferable in usual to use those having a substituted active group such as an alkoxyl group, an acyloxyl group, a hydroxyl group obtained by hydrolysis and so on or an alkali metal salt thereof at the silicon atom contained in the molecule.

Details of a production process of such a polyvinylalcohol having a silicon atom in it's molecular structure is described in Japanese patent application (OPI) No. 193189/83. The colloidal silica used in the present invention is employed as a colloidal solution obtained by dispersing super fine particles of silicic acid anhydride into water.

Preferred particle size of the colloidal silica is from 10 m to 100 m and preferred specific gravity of it is from 1.1 to 1.3. In this case preferred PH value of the colloidal solution is from about 4 to about 10.

When a protective layer comprising at least above mentioned modified polyvinylalcohol with silicon and colloidal silica is prepared on a surface of a heat sensitive material, to a great surprise, a transparency of the protective layer is quite excellent, therefore a tranbsparency of the heat sensitive material can be remarkably improved. Moreover, if such protective layer is provided on the outermost layer of the recording material surface hardness is improved, and if such protective layer is provided as interlayer of the recording material mixing hue which is not necessary can be prevented.

A proper mixing ratio of the modified polyvinylalcohol with silicon to the colloidal silica, in the present invention, is 0.5–3 parts by weight preferably 1–2 parts by weight of colloidal silica per 1 part by weight of modified polyvinylalcohol with silicon. If the amount of the colloidal silica is less than 0.5 part by weight, it can not bring sufficient effect for improvement on a transparency, and if it is used in an amount more than 3 parts by weight a crack occurs in the protective layer which reduces the transparency.

In the protective layer, more than one other polymers can be used together with above polymer. Some of those polymers are water soluble polymers such as a methylcellulose, a carboxymethylcellulose, a hydroxymethylcellulose, a starchs, a gelatin, a gum arabic, a casein, a hydrolyzed product of styrene-maleic anhydride copolymer, a hydrolyzed half-ester product of styrene-maleic anhydride copolymer, a polyvinylalcohol, a modified polyvinylalcohol with carboxyl group, a polyacrylamide derivatives, a polyvinyl pyrrolidone, a polystyrene sodium sulfate, a sodium alginate; styrenebutadiene rubber latex, acrylnitrile-butadiene rubber latex, methylacrylate-butadiene rubber latex, a water insoluble polymer such as polyvinylacetate emulsion. A preferred amount to be used together is from 0.01 to 0.5 part by weight per 1 part by weight of modified polyvinylalcohol with silicon.

In the protective layer, a pigment, metal soap, wax or cross-linking agent etc. can be added in order to improve matching of the heat sensitive material with thermal head when thermal recording is performed or to improve water resisting property of the protective layer.

Some of the pigments are a zinc oxide, a calcium carbonate, a barium sulfate, a titanium oxide, a lithopone, a talc, an agalmatolite, a kaolin, an aluminum hydroxide, an amorphous silica etc., an amount to be added is 0.05–2 times of an amount of total weight of polymer, especially 0.1–0.5 times are preferable. An amount less than 0.05 times can not improve the matching of the heat sensitive recording material with thermal head, on the other hand an amount more than 2 times reduces both transparency and sensitivity of heat sensitive recording material remarkably, which causes damage on commercial value.

Some of the metal soaps are an emulsion of metal salt of higher fatty acid (e.g., a zinc stearate, a calcium stearate, an aluminum stearate) etc., and it's amount to be added is 0.5–20 weight %, preferably 1–10 weight % against total weight of the protective layer. Some of the waxes are a paraffin wax, a microcrystalline wax, a carnauba wax, a methylol stearoamide, a polyethylene wax, an emulsion of silicone etc., and an amount thereof to be added is 0.5–40 weight %, preferable 1–20 weight % against total weight of the protective layer.

In a coating solution for the protective layer a surface active agent is added in order to prepare the protective layer uniforming on the heat sensitive layer. Some of the active agents are an alkali metal salt of sulfosuccinic acid system and an active surface agent containing fluorine atoms etc., concretely they are a sodium salt or an ammonium salt etc., of a di-(2-ethylhexyl) sulfosuccinic acid or di-(n-hexyl) sulfosuccinic acid etc.

Other surface active agents or polymer electrolytes can also be added in the protective layer as an antistatic agent.

A preferable amount of the protective layer to be coated is usually 0.2–5 g/m$^2$, particularly 1 g–3 g/m$^2$ at the solids coverage.

Now, a transparent support to be used in the present invention is illustrated below.

The term transparent support as used herein is intended to include films of polyesters such as polyethylene terephthalate, polybutylene terephthalate and the like, cellulose derivative films like a cellulose triacetate film, polyolefin films such as a polystyrene film, a polypropylene film, a polyethylene film and the like and so on. These films may be used, independently or in a laminated form.

A preferred thickness of such a transparent support is within the range of 20 to 200 microns, particularly 50 to 100 microns.

A subbing layer which can be employed in the present invention functions so as to heighten the adhesiveness between the transparent support and the heat sensitive layer. As a material for forming the subbing layer, mention may be made of gelatin, synthetic high polymer latexes, nitrocellulose, and so on. A preferred coverage of the subbing layer ranges from 0.1 to 2.0 g/m$^2$, particularly from 0.2 to 1.0 g/m$^2$. When the coverage is below 0.1 g/m$^2$, adhesion of the heat sensitive layer to the support is insufficient, whereas even when it is increased beyond 2.0 g/m$^2$, the adhesion power attains saturation to bring about only increase in cost.

It is to be desired that the subbing layer should be hardened with a hardener because it sometimes swells by water contained in the heat sensitive layer coated thereon to cause deterioration of image formed in the heat sensitive layer.

As examples of hardeners which can be used in the present invention, mention may be made of:

(1) active vinyl-containing compounds, such as divinylsulfone, N,N'-ethylenebis(vinylsulfonylacetamide), 1,3-bis(vinylsulfonyl)-2-propanol, methylenebismaleimide, 5-acetyl-1,3-diacryloyl-hexahydro-s-triazine, 1,3,5-triacryloyl-hexahydro-s-triazine, 1,3,5-trivinylsulfonylhexahydro-s-triazine, and the like, (2) active halogen-containing compounds, such as sodium salt of 2,4-dichloro-6-hydroxy-s-triazine, 2,4-dichloro-6-methoxy-s-triazine, sodium salt of 2,4-dichloro-6-(4-sulfoanilino)-s-triazine, 2,4-dichloro-6 -(2-sulfoethylamino)-s-triazine, N,N'-bis( 2-chloroethylcarbamyl)piperazine, and the like, (3 ) epoxy compounds, such as bis(2,3-epoxypropyl)-methylpropylammonium-p-toluenesulfonate, 1,4-bis(2',3'-epoxypropyloxy)-butane, 1,3,5-triglycidylisocyanurate, 1,3-diglycidyl-5-( -acetoxy-oxypropyl)isocyanurate, and the like.

(4) ethyleneimino compounds, such as 2,4,6-triethylene-sk-triazine, 1,6,-hexamethylene-N,N'-bisethyleneurea, bis-ethyleneiminoethylthioether, and the like, (5) methanesulfonate compounds, such as 1,2-di(methanesulfonoxy)ethane, 1,4-di(methanesulfonoxy)-butane, 1,5-di(methanesulfonoxy)pentane, and the like, (6) carbodiimide compounds, such as dicyclohexylcarbodimide, 1-cyclohexyl-3-(3-trimethylaminopropyl)carbodiimido-p-triethanesulfonate, 1 -ethyl-3-(3-dimethylaminopropyl)carbodiimide hydrochloride, and the like, (7) isooxazole compounds, such as 2,5-dimethylisooxazole perchlorate, 2-ethyl-5-phenylisooxazole-3-sulfonate, 5,5'-(p-phenylene)bisisooxazole, and the like, (8) inorganic compounds, such as chrome alum, bolic acid, zirconium salt, chromium acetate, and the like, (9) dehydrating condensation type peptide reagents such as N-carboethoxy-2-isopropoxy-1,2-dihydroquinoline, N-(1-morpholinocarboxy)-4-methylpyridinium chloride and the like, and active ester compounds such as N,N'-adipolyldioxydisuccinimide, N,N'-terephthaloyl-dioxydisuccinimide and the like, and

(10) isocyanates, such as toluene-2,4-diisocyanate, 1,6-hexamethylenediisocyanate and the like.

(11) aldehydes such as glutaric aldehyde, glyoxal, dimethoxy urea, 2,3-dihydroxy-1,4-dioxane and the like.

Among these hardeners, especially aldehydes such as glutaric aldehyde, or 2,3-dihydroxy-1,4-dioxane, and boric acid are preferable.

Such a hardner is added in a proportion ranging from 0.20 to 3.0 wt. % to the weight of the materials to constitute the subbing layer. A proper amount to be added can be selected depending on the coating method, the intended degree of hardening.

When the addition amount of a hardener is below 0.20 wt. %, sufficient hardening can not be achieved however long the time elapsed is, and therefore the subbing layer swells upon coating of the heat sensitive layer, whereas when the hardener is added in a concentration higher than 3.0 wt. % the hardening proceeds too fast, and therefore the adhesiveness between the subbing layer and the support is lowered to result in peeling of the subbing layer from the support in the form of a film.

According to the hardener used, the pH of a coating solution for the subbing layer can be rendered alkaline by the addition of sodium hydroxide or the like, or acidic by the addition of citric acid or the like, if needed.

Further, a defoaming agent can be added in order to eliminate foams generated upon coating, and a surface active agent can also be added in order to level the surface of the coating solution in a good condition to result in prevention of coating streaks.

Furthermore, an antistatic agent can be added, if needed.

Before coating of the subbing layer, the surface of a support is preferably subjected to an activation processing according to known methods. As a method for the activation processing, mention may be made of an etching processing with an acid, a flame processing with a gas burner, a corona discharge processing, glow discharge processing, and so on. From the viewpoint of cost or simplicity, corona discharge processing described in U.S. Pat. Nos. 2,715,075, 2,846,727, 3,549,406 and 3,590,107, and so on are employed to the greatest advantage.

Coating compositions prepared in accordance with the present invention are coated using a dip coating process, an air knife coating process, a curtain coating process, a roller coating process, a doctor coating process, a wire bar coating process, a slide coating process, a gravure coating process, an extrusion coating process, using a hopper described in U.S. Pat. No. 2,681,294, or so on. Two or more of different coating compositions can be coated simultaneously, if desired, using methods described in U.S. Pat. Nos. 2,761,791, 3,508,947, 2,941,898 and 3,526,528, Yuji Harasaki, Coating Kogaku (which means "Coating Engineering"), p. 253, Asakura Shoten (1973), and so on. An appropriate method can be chosen from the above-cited ones depending on intended coverage, coating speed, and so on.

In the coating compositions of the present invention, it is allowed to compound properly a pigment dispersing agent, a viscosity increasing agent, a fluidity modifying agent, a defoaming agent, a foam inhibitor, a mold lubricant, a coloring agent and so on so far as they have no adverse influences upon characteristics.

The heat sensitive material of the present invention can be employed as sheet for high-speed recording facsimiles and printers for electronic computers. In high-speed recording, differing from the recording with general type facsimiles and printers, it is to be desired that an apparatus equipped with a so-called double thermal head, which enables simultaneous heat recording on both sides, should be used. On the other hand, after recording on one side with a conventional single thermal head recording may be carried out again on the other side of the sheet made to turn back facing its back side upward. In any case, if diazo compounds are used as color-forming component, additional incorporation of an exposure zone for the photolysis of the diazo compounds in a recording apparatus is advantageous from the standpoints of ensuring keeping quality of the produced image and increasing numbers of producible hues.

Arrangements of printing heads and exposure zones are classified roughly into two ways. In one way, after printing is carried out once, the recording sheet is subjected to optical exposure for photolysis; after this exposure, the recording sheet is turned back to the place where the printing was once carried out through a sending mechanism for the recording sheet in such a condition that the recording sheet waits for printing on the intended area thereof; and further are repeated such operations that the printing and the optical exposure are carried out again, in this order, and then the recording sheet is turned back to the place for printing. That is to say, the above-described way belongs to a so-called one-head multi-scanning method. In the other way, an recording apparatus equipped with recording heads in the same numbers as those of colors to be recorded and exposure zones arranged between every adjacent recording heads is used. Namely, this way belongs to a so-called multihead one-scanning method. Those two ways may be used in combination, if needed. In addition, thermal energy to be supplied to a recording head may be changed, if needed. As for the light sources for photolyses, on the other hand, various kinds of light sources can be used, provided that they can be emit light of desired wavelengths. For instance, various kinds of fluorescent lamps, a xenon lamp, a xenon flash lamp, mercury lamps in which mercury vapor is enclosed at various pressures, a flash for photograph-taking, a Strobe, and so on can be used.

In order to make the photofixation zone compact, a light source part and an exposure part may be set in separate positions, and these parts may be connected with optical fiber.

According to circumstances, a multicolor sample can be obtained in such a manner that a recording material on which printing was once done may be placed under sun light, a fluorescent lamp or the like, whereby achieving fixation by mainly utilizing light in the visible region, and then subjected to printing once more.

(EXAMPLES)

The present invention will now be illustrated in more detailed by reference to the following examples. However, the present invention should not be construed as being limited to these examples.

Additionally, in the following examples, all parts are by weight unless otherwise indicated.

Preparation of Diazo Capsule Solution (A):

Diazo Compound illustrated below

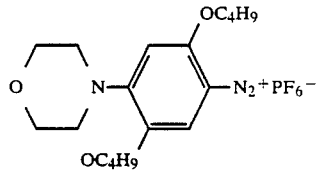

3.4 parts

| | |
|---|---|
| Tricresyl Phosphate | 6 parts |
| Methylene Chloride | 12 parts |
| Trimethylolpropane Trimethacrylate | 18 parts |
| Takenate D-110N(75 wt % ethyl acetate solution, produced by TAKEDA YAKUHIN KOGYO K.K.) | 24 parts |

The above-described ingredients were mixed, and added to a water solution prepared by mixing 63 parts of a 8 wt. % water solution of polyvinyl alcohol and 100 parts of distilled water. The resulting mixture was converted to an emulsion having a mean particle size of 2 microns by a dispersion treatment at 20° C. The stirring of the emulsion was allowed to continue for 3 hours at 40° C.

Thereafter, the emulsion was cooled to 20 ° C. and thereto was added 100 cc of Amberlite IR-120B (trade name, product of Rohm & Haas Co.). The mixture was stirred for one hour, and then passed through a filter. Thus, the capsule solution (A) was obtained.

Preparation of Coupler/Base Dispersion (A) (Emulsion)

Coupler illustrated below (I). 4 g wt. % Water Solution of Polyvinyl Alcohol 170 parts (II). Coupler

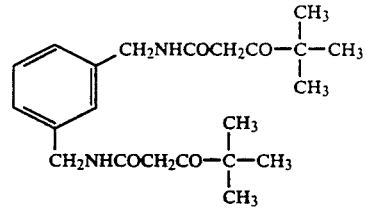

14 parts

Triphenylguanidine (base) color-producing assistant 6 parts

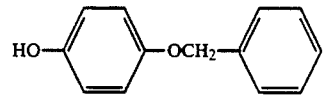

14 parts

| | |
|---|---|
| Tricressyl phosphate | 10 parts |
| Ethyl acetate | 20 parts |

The solution (II) as added into the solution (I), then emulsified at 20° C. to obtain dispersed emulsion.

Preparation of Coupler/Base Dispersion (B):(Solid Dispersed Solution)

The coupler, the base and the polyvinylalkohol were mixed with each other in the same ratio to that of Coupler/Base Dispersion (A), then dispersed using a Dyno MILL (trade name, product of Willy A Bachofen A. G. Co., Ltd.), and thereby was prepared a dispersion having a mean particle size of 3 microns.

Preparation of Color-producing Assistance Dispersion (A):

28 parts of the color-producing assistant illustrated below:

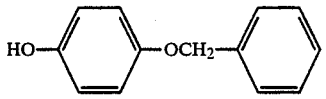

and 138 parts of a 4 wt. % water solution of polyvinyl alcohol were mixed, and dispersed with a Dyno Mill (trade name, product of Willy A. Backofen A. G. Co., Ltd.). Thus, a dispersion having a mean particles size of 3 microns was obtained.

Preparation of Capsule Solution (B):

Basic Colorless Dye Precursor (Blue 200, produced by YAMADA KAGAKU K.K.) illustrated below:

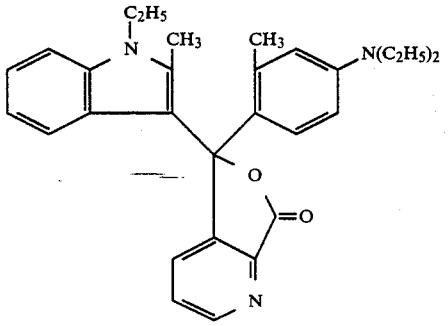

14 parts

| | |
|---|---|
| 1-phenyl-1-xylylethane | 55 parts |
| Methylene Chloride | 55 parts |
| Sumisorp 200 (ultraviolet absorbent, produced by SUMITOMO KAGAKU K.K.) | 2 parts |
| Takenate D-110N (produced by TAKEDA YAKUHIN KOGYO K.K.) | 60 parts |

The above-described ingredients were mixed, and added to a water solution prepared by mixing 100 parts of a 8 wt. % water solution of polyvinyl alcohol and 40 parts of distilled water. The resulting mixture was converted to an emulsion having a mean particle size of 1 micron by a dispersion treatment at 20° C. The stirring of the emulsion wa allowed to continue for 3 hours at 40° C. to produce the capsule solution (B).

Preparation of Capsule Solution (C):

The capsule solution (C) was prepared in the same manner as those described in the capsule solution (B), except the following compound (CIBA Pergascript Red I-6-B), was used as the electron donating colorless dye precursor:

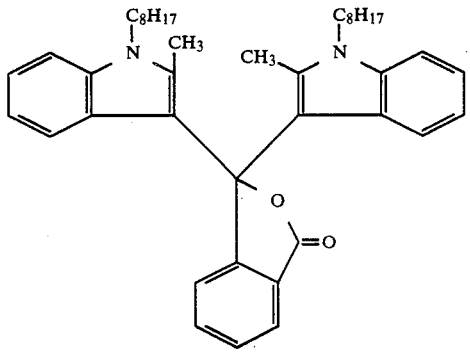

14 parts

Preparation of Color Developer Emulsified Dispersion A:

The color developers (a), (b) and (c), illustrated below, were dissolved in amounts of 8 parts, 4 parts and 30 parts, respectively, into a mixture of 8 parts of 1-phenyl-1-xylylethane and 30 parts of ethyl acetate. The resulting solution was admixed with a water solution consisting of 100 parts of a 8 wt. % of water solution of polyvinyl alcohol, 150 parts of water and 0.5 part of sodium dodecylbenzenesulfonate to be converted to an emulsified dispersion having a mean particle size of 0.5 micron.

Color Developer (a)

Zinc salt of

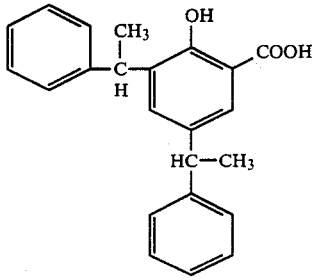

Color Developer (b)

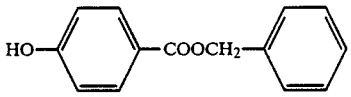

Color Developer (c)

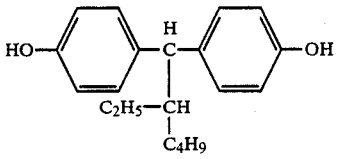

Preparation of Color Developer Dispersion B (Solid Dispersed Solution)

8 parts , 4 parts and 30 parts of color developers (a), (b) and (c) respecting were added into a solution of 100 parts of 8 weight % of polyvinylalkohol and 150 parts of water then dispersed by Dyno Mill to obtain a dispersed solution containing an average of 3 microns.

Preparation of a Coating Solution (1) Preparation of Coating Solution (A) (Cyan)

| | |
|---|---|
| Capsule Solution (B) | 5.0 parts, |
| Color Developer Dispersion A (Emulsion) | 10.0 parts and |
| Distilled Water | 5.0 parts |

(2) Preparation of Coating Solution (A') (Cyan)

A coating solution (A) was obtained in the same manner as those described in the coating solution (A) except using color developer dispersion (solid dispersed solution) (B) instead of color developer dispersion (A).

(3) Preparation of Coating Solution (B) (Magenta)

| | |
|---|---|
| Capsule Solution (C) | 5.0 parts, |
| Color Developer Dispersion (A) (Emulsion) | 10.0 parts and |
| Distilled Water | 5.0 parts |

were mixed by agitation to obtain a coating solution (B).

(4) Preparation of Coating Solution (B') (magenta)

A coating solution (B') was obtained in the same manner as those described in the coating solution (B) except using color developer dispersion (solid dispersed solution) (B) instead of color developer dispersion (B).

(5) Preparation of Coating Solution (C) (Yellow)

| | |
|---|---|
| Capsule Solution (A) | 4.9 parts, |
| 5 weight % Aqueous Hydroquinone | 0.2 parts and |
| Coupler/base dispersion (A) | 3.7 parts |

were mixed by agitation to obtain a coating solution (C).

(2) Preparation of Coating Solution (C') (Yellow)

A coating solution (C') was obtained in the same manner as those described in the coating solution (C) except using 3.7 parts of coupler/base dispersion (B) and 3.7 parts of color-producing assistance dispersion (A) instead of 3.7 parts coupler/base dispersion (A).

Preparation of Recording Sheet A

A 75 micron thick polyethylene terephthalate film which had received a biaxial streching treatment was used as a transparent support, and subjected to a corona discharge treatment on both side. Thereafter, the coating composition A was coated on one side (side A) of the transparent support and dried, while the coating composition B was coated on the other side (side B), then provided intermediate layer of the composition shown below and the coating solution C was coated on the intermediate layer. Each coating on coating solution A, B and C was controlled so that the dry coverage of each layer becomes 12 g/m$^2$ and coating of the intermediate layer was controlled so that the coverage becomes 2 g/m$^2$. Then 2 micron thick protective layers having the same composition to that of the intermediate layers were coated on both side to obtain a recording sheet A.

| Composition of Intermediate (Protective) Layer | |
|---|---|
| Silica-denatured Polyvinyl Alcohol (PVA R2105, produced by KURARE K.K.) | 1 part (on solidsbasis) |
| Colloidal Silica (Snowtex 30, produced by NISSAN KAGAKU K.K.) | 1.5 parts (on solids basis) |
| Zinc Stearate (Hydolin Z-7, produced by CHUKYO YUSHI K.K.) | 0.2 part (on solids basis) |
| Paraffin Wax (Hydolin P-7, produced by CHUKYO YUSHI K.K.) | 0.02 part (on solids basis) |

Preparation of Recording Sheet(B)

A recording sheet(B) was obtained as the same manner as those described in the recording sheet(A) except using the coating solution (C') instead of the coating solution (C).

Preparation of Recording Sheet (C) (Comparative)

A recording sheet (C) was obtained as the same manner as those described in the recording sheet (A) except using the coating solutions (A'), (B') and (C') instead of the coating solutions (A), (B) and (C) respectively.

Preparation of sheets for measurement of the transparency.

Recording sheets (a), (a'), (.b), (b'), (c) and (c') were obtained by coating the coating solution (A), (A'), (B), (B'), (C) and (C') respectively on the aforementioned transparent supports in an amount of 12 g/m$^2$, then providing the aforementioned protective layer in an amount of 2 g/m$^2$.

EXAMPLE 1

Haze % of each samples of recording sheets (A),(B), (C) and sheets for measurement of the transparency (a), (a'), (b) and (b') was measured with HTR meter based on integral sphere method (Produced by NIPPON SEMITSU KOGYO K.K.) respectively , wherein recording sheets (A), (B) and (C) were measured from cyan coloring side. The results were shown in Table 1.

TABLE 1

| Sample | Haze (%) | Transparency |
|---|---|---|
| Recording sheet (a) | 16 | good |
| Recording sheet (a') | 80 | not good |
| Recording sheet (b) | 15 | good |
| Recording sheet (b') | 82 | not good |
| Recording sheet (c) | 17 | good |
| Recording sheet (c') | 81 | not good |
| Recording sheet (A) | 18 | good |
| Recording sheet (B) | 75 | not good |
| Recording sheet (C) | 95 | not good |

These results prove that quite good transparency can be realized by using a coating solution comprised of microcapsules containing a diazo compound or an electron donating dye presursor as a core material, and an emulsified dispersion obtained by dispersing a coupler or a color developer into an organic solvent slightly soluble in water.

EXAMPLE 2

Yellow or Cyan color was produced on each side of the recording sheet(A) when each side was heated at random for 1 second using a block heated to 100° C.

After 10 seconds' exposure with a Ricopy Super Dry Model 100 (400–430 nm), the recording sheet was heated from yellow colored side for 1 second with a block heated to 120° C. to result in magenta coloration on the heated spots.

As described above, the recording sheet produced yellow color and cyan color on both sides, respectively, by printing at a low temperature prior to light exposure. After photolysis of the diazo compounds (in the yellow coloring layer) by light exposure, the resultant recording sheet was subjected to printing at a somewhat higher temperature than before to result in magenta coloration. Thus, when the recording sheet was observed from one side, cyan, magenta, yellow, blue (cyan+magenta), green (cyan+yellow), red (yellow+magenta) and black (cyan+magenta+yellow) color images were found therein. These images were all clear, free from needless color stain and blur.

EXAMPLE 3

The recording sheet B (Example 2) was recorded as the same manner as described in the recording sheet A. A reflected multi color image, which was clear and free from needless color stain and blur, was obtained by observing from cyan colored side since the diazo compound layer of opposite side which was substantially apaque offered white background after photofixation.

COMPARATIVE EXAMPLE

The recording sheet C was recorded as the same manner as described in the recording sheet A, however, obtained color image was worse in color separation and clearness than those observed in the cases of recording sheets A and B, because of an insufficient of transparency of each coloring layer.

What is claimed is:

1. A multicolor heat-sensitive recording material which comprises a transparent support having two or more of color-producing unit layers differing in hue of the produced color in such a situation that at least two of the unit layers of differing hue are provided on opposite sides of the support, wherein at least one color-producing layer is essentially transparent, the haze % as measured with HTR meter based on integral sphere method of each of said transparent color-producing layer is less than 40% and said transparent layer is prepared by coating a composition containing a combination of a photo-decomposable diazonium compound and a coupler or a combination of an electron donating dye precursor and a color developer as a color former together with other additives; said combination being present in sufficient quantity within the respective layers to form a color image upon processing; at least said diazonium compound or electron donating dye precursor is enclosed in a microcapsule, on the other hand said coupler or color developer which exists in the composition with said microcapsule is dispersed in an emulsion obtained by dissolving said coupler or color developer into an organic solvent slightly soluble or insoluble in water then subjecting the resulting solution to an emulsifying dispersion treatment.

2. The multicolor heat-sensitive recording material as claimed in claim 1, wherein said Haze % is less than 30%.

3. The multicolor heat-sensitive recording material as claimed in claim 1 wherein a protective layer is further coated on the outer most color-producing unit layer of each side of the recording material.

4. The multicolor heat-sensitive recording material as claimed in claim 3, wherein said protective layer is comprised of modified polyvinylalcohol with silicon and colloidal silica.

5. The multicolor heat-sensitive recording material as claimed in claim 4, wherein mixing ratio of said modified polyvinylalcohol with silicon to said colloidal silica is 0.5–3 parts by weight.

6. The multicolor heat-sensitive recording material as claimed in claim 4, wherein said modified polyvinylalcohol with silicon is selected from a group of those having a substituted active group comprised of an alkoxyl group, an acyloxyl group, a hydroxyl group or an alkali metal salt thereof at the silicon atom contained in the molecule.

* * * * *